US006619884B2

(12) United States Patent
Davis et al.

(10) Patent No.: US 6,619,884 B2
(45) Date of Patent: Sep. 16, 2003

(54) BARRIER DEVICE AND METHOD FOR BUILDING BARRIER WALL

(75) Inventors: Richard C. Davis, Central Lake, MI (US); Matthew Anthony Davis, Tempe, AZ (US); Andrew Clinton Davis, Williamburg, MI (US)

(73) Assignee: Beaver Bags, Inc., Williamsburg, MI (US)

( * ) Notice: Subject to any disclaimer, the term of this patent is extended or adjusted under 35 U.S.C. 154(b) by 0 days.

(21) Appl. No.: 09/849,964

(22) Filed: May 4, 2001

(65) Prior Publication Data

US 2002/0164210 A1 Nov. 7, 2002

(51) Int. Cl.[7] ..... E02B 7/08

(52) U.S. Cl. ..... 405/111; 405/114; 405/302.6; 405/284; 405/21

(58) Field of Search ..... 405/114–115, 107, 405/91, 15–22, 25, 111, 284–286, 184.4, 172, 302.6

(56) References Cited

U.S. PATENT DOCUMENTS

| | | | | | |
|---|---|---|---|---|---|
| 2,669,272 | A | | 2/1954 | Permann | |
| 2,696,235 | A | | 12/1954 | Toffolon | |
| 3,282,621 | A | | 11/1966 | Peterson | |
| 3,283,992 | A | | 11/1966 | Hanson et al. | |
| 3,561,219 | A | * | 2/1971 | Nishizawa et al. | 405/19 |
| 3,642,679 | A | | 2/1972 | Young | |
| 3,696,623 | A | * | 10/1972 | Heine et al. | 405/19 |
| 3,793,845 | A | * | 2/1974 | Keith | 405/172 |
| 3,886,751 | A | | 6/1975 | Labora | |
| 3,922,832 | A | | 12/1975 | Dicker | |
| 4,085,851 | A | | 4/1978 | Young | |
| 4,248,364 | A | | 2/1981 | Anderson | |
| 4,362,433 | A | | 12/1982 | Wagner et al. | |
| 4,421,368 | A | | 12/1983 | Saban | |
| 4,421,805 | A | | 12/1983 | Prader | |
| 4,477,206 | A | * | 10/1984 | Papetti et al. | 405/172 |
| 4,479,243 | A | | 10/1984 | Derby et al. | |
| 4,588,154 | A | | 5/1986 | Basore | |
| 4,650,368 | A | | 3/1987 | Bayer | |
| 4,690,585 | A | * | 9/1987 | Holmberg | 405/15 |
| 4,744,446 | A | | 5/1988 | Arney | |
| 4,765,381 | A | | 8/1988 | Castle | |
| 4,836,343 | A | | 6/1989 | Arney | |
| 4,940,364 | A | * | 7/1990 | Dlugosz | 405/19 |
| 4,981,392 | A | * | 1/1991 | Taylor | 405/15 |
| 5,114,270 | A | | 5/1992 | Riddle | |
| 5,158,395 | A | * | 10/1992 | Holmberg | 405/15 |
| 5,385,430 | A | * | 1/1995 | Connors | 405/172 |
| 5,584,599 | A | | 12/1996 | Knittel | |
| 5,669,732 | A | | 9/1997 | Truitt | |
| 5,743,650 | A | | 4/1998 | Shannon et al. | |
| 6,220,788 | B1 | * | 4/2001 | Jewell | 405/172 |
| 6,428,240 | B1 | * | 8/2002 | Ehrlich et al. | 405/114 |

* cited by examiner

*Primary Examiner*—Heather Shackelford
*Assistant Examiner*—Frederick L. Lagman
(74) *Attorney, Agent, or Firm*—Thomas J. Ring; Wildman, Harrold, Allen & Dixon

(57) ABSTRACT

A barrier device includes a first containment chamber and a second containment chamber. The first containment chamber is secured to the second containment chamber by a connector. A barrier wall includes a first barrier device having a first containment chamber, a second containment chamber, and a connector. A containment chamber of a second barrier device is positioned between the first containment chamber and the second containment chamber and is positioned in overlying relationship to the connector. A barrier wall is built by positioning a first barrier device, having a first containment chamber, a second containment chamber, and a connector on a support surface. A containment chamber of a second barrier device is positioned between the first containment chamber and the second containment chamber of the first barrier device and overlying the connector.

124 Claims, 3 Drawing Sheets

BARRIER DEVICE AND METHOD FOR BUILDING BARRIER WALL

FIELD

This invention relates generally to barrier devices and more specifically to barrier devices used to build barrier walls.

BACKGROUND

Barrier devices, such as sandbags, are used to build makeshift barrier walls, that serve a variety of purposes. For instance, towns and municipalities located on flood plains build barrier walls to protect property from onrushing floodwater, road or highway commissions build retaining walls to prevent automobiles from driving off treacherous stretches of road, and military or police agencies build fortifications to prevent unauthorized vehicles from entering secure areas as well as to provide a barrier to resist ballistic penetration. These are only some of the functions for which barrier walls are used.

Regardless of their use, however, barrier walls must be easily assembled and provide sufficient stability to perform their intended functions. For example, a municipality with onrushing floodwater must build a stable wall quickly. Accordingly, the barrier devices used to construct barrier walls must have characteristics that provide for speedy construction and stability.

Unfortunately, many common barrier devices lack these characteristics. Conventional sandbags, for instance, are unwieldy, difficult to align, and it often takes a plethora of them to build a single wall. Sandbag walls also lack stability and onrushing water and moving objects often topple sandbag walls.

Accordingly, there is a need for a barrier device that is easily transported, easily aligned, and provide barrier walls with superior stability to that of conventional barrier walls. In addition, there is a need for a barrier wall, and a method for building a barrier wall with a barrier device of this type.

SUMMARY

Pursuant to the present invention, shortcomings of the existing art are overcome and additional advantages are provided through the provision of a barrier device and method for building barrier walls.

The invention in one example comprises a barrier device. The barrier device includes a first containment chamber and a second containment chamber. The first containment chamber is secured to the second containment chamber by a connector.

The invention, in another example, encompasses a barrier device. In the barrier device a sidewall defines at least one chamber. At least one loop that is constructed of a strip is secured at opposing ends of the strip to the sidewall to permit insertion of a rigid support member into the at least one loop.

The invention in a further aspect, encompasses a barrier wall. The barrier wall includes a first barrier device having a first containment chamber, a second containment chamber, and a connector. A containment chamber of a second barrier device is positioned between the first containment chamber and the second containment chamber and is positioned in overlying relationship to the connector.

The invention in another aspect comprises a method. A first barrier device, having a first containment chamber, a second containment chamber, and a connector is positioned on a support surface. A containment chamber of a second barrier device is positioned between the first containment chamber and the second containment chamber of the first barrier device and overlying the connector.

These and other features are apparent from the following detailed description and accompanying drawings and the appended claims.

DETAILED DESCRIPTION

Figure 1:
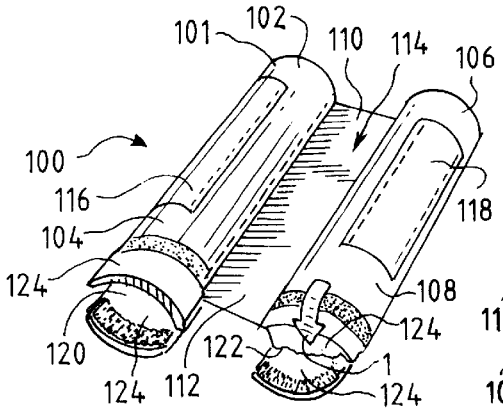
FIG. 1 is a front perspective view of an embodiment of a barrier device.
Figure 2:
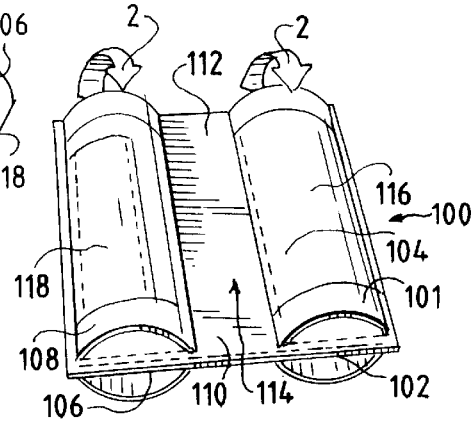
FIG. 2 is a back perspective view of the barrier device of FIG. 1 with closed containment chambers.

Referring to FIGS. 1 and 2, barrier device 100 comprises a sidewall 101. Sidewall 101 in one example is constructed of a material that is strong enough to hold a filler material, such as sand or other suitable materials. Examples of such a material include but are not limited to heavy duty fabric, heavy duty plastic, and/or reinforced plastic cloth. The material should have sufficient flexibility to allow the barrier device 100 to conform in shape to a support surface such as the ground or another barrier so as to create a barrier wall. In one example, the material could be waterproof.

Sidewall 101 comprises three portions: a first portion 102 that defines a first containment chamber 104, a second portion 106 that defines a second containment chamber 108, and a third portion 110 that defines a connector 112. Sidewall 101 in one example is substantially rectangular in shape. Accordingly, the length of sidewall 101 is greater than the width of sidewall 101.

Both first containment chamber 104 and second containment chamber 108 comprise a space that receives a filler material. Containment chambers 104, 108, when filled and positioned relative to containment chambers of other barrier devices, are used to build a barrier wall.

Connector 112 performs a variety of functions, such as securing first containment chamber 104 to second containment chamber 108. Connector 112 is positioned between first containment chamber 104 and second containment chamber 108, and extends along at least a portion of the length of containment chambers 104, 108. Connector 112 has a lower elevation relative to an elevation of first containment chamber 104 and second containment chamber 108 when containment chambers 104, 108 contain a filler material and are positioned on a support surface. The elevation of first containment chamber 104 and second containment chamber 108 with respect to connector 112 forms channel 114. Channel 114 extends along the length of containment chambers 104, 108. Channel 114 can receive a containment chamber of another barrier device, as will be described in more detail herein.

Referring further to FIGS. 1 and 2, positioned on the top side of sidewall 101 within an area that is defined by the containment chamber 104 and second containment chamber 108 are first loop 116 and second loop 118. First loop 116 and second loop 118 permit the insertion of one or more support members, such as wooden or steel poles, between the loops and the top side of sidewall 101. Loops 116, 118 act as lift loops to allow users of barrier device 100 to lift, position, and/or carry barrier device 100 as will be described in more detail herein.

Referring now to FIG. 1, the first portion 102 of sidewall 101 further defines first opening 120 that is in communication with first containment chamber 104. Second portion 106 defines second opening 122 that is in communication with second containment chamber 108. In one example both first opening 120 and second opening 122 are positioned at the same end of and along the width of sidewall 101. Filler material is inserted into barrier device 100 through first opening 120 and second opening 122. Both first opening 120 and second opening 122 can be closed and sealed by flaps 124 to prevent filler material from leaking out of the containment chambers 104, 108.

Figure 3:
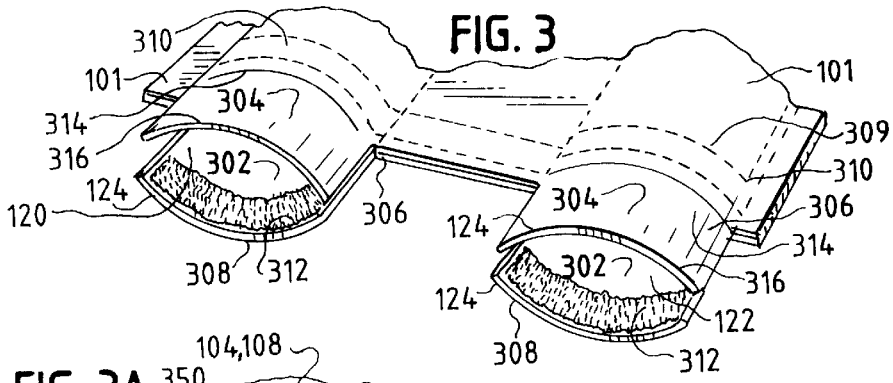
FIG. 3 is an enlarged partial front perspective view of the barrier device of FIG. 1.

Referring to FIG. 3, flaps 124, in one example, comprise securement flaps 302 and insert flaps 304. Securement flaps 302 extend along the first opening 120 and the second opening 122, respectively. Each securement flap 302 has a first end 306 that is attached to the sidewall 101 along its respective opening. In one example, first end 306 is attached integrally to the sidewall 101.

Each securement flap 302 also has second end 308. In one example, second end 308 is releasably securable to another portion 309 of sidewall 101 along first opening 120 and second opening 122 respectively, through the employment of connecting strips 310 and connecting strips 312.

Connecting strips 310 are each attached to the other portion 309 of sidewall 101 and extend along each of first opening 120 and second opening 122. Connecting strips 312 each are attached to second end 308 of securement flaps 302 along widths that correspond to the first opening 120 and the second opening 122, respectively.

In one example, connecting strips 312 carry the opposite hook or loop fasteners that connecting strips 310 carry. Accordingly, connecting strips 310 and the connecting strips 312 carry mating hook and loop fasteners.

Securement flaps 302 are employed to close and seal first opening 120 and the second opening 122. To close and seal openings 120, 122 each securement flap 302 is bent so as to overly its respective opening 120, 122 (see arrows 2 in FIG. 2). Connecting strips 312 located at second end 308 of each securement flap 302 are then each connected to mating connecting strips 312 attached to the sidewall 101.

Referring still to FIG. 3, insert flaps 304 are employed to seal openings 120, 122. Each insert flap 304 extends along either first opening 120 or second opening 122 of sidewall 101, respectively. Each insert flap 304 has a first end 314 that is attached to the sidewall 101 along first opening 120 and second opening 122 respectively. In one example first end 314 is attached to the other portion 309 of sidewall 101. In another example, the first end 314 is integral to the other portion 309 of sidewall 101. Each insert flap 304 also has a second end 316. In one example, second end 316 is insertable into first opening 120 and second opening 122 respectively.

When insert flaps 304 are employed to seal first opening 120 and second opening 122, each insert flap 304 is bent so as to overly its respective opening 120, 122 (see arrow 1 in FIG. 1). A portion of second end 316 of each insert flap 304 is then inserted into first opening 120 and second opening 122, respectively. Securement flaps 302 then overly insert flaps 304 and hold insert flaps 304 in place when the hook and loop connecting strips 310, 312 are engaged. In this manner, securement flaps 302 and insert flaps 304 work in conjunction to close and seal first opening 120 and second opening 122.

Figure 3A:
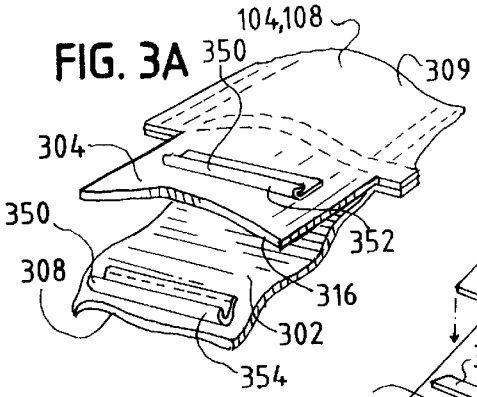
FIG. 3A is an enlarged partial front perspective view of a barrier device employing interlocking fasteners to close a containment chamber.

Referring to FIG. 3A, in one example, mating interlocking fasteners 350 could be used instead of connecting strips 310, 312 to close first containment chambers 104 and/or second containment chamber 108. Interlocking fasteners 350 in one example comprise elongated strips of plastic each having a "J" crossection.

A first interlocking fastener 352 is attached to other portion 309 of sidewall 101 and extends along first opening 120 and/or second opening 122. A second interlocking fastener 354 is attached to second end 308 of securement flap 302 along a width that corresponds to first opening 120 and/or the second opening 122. In one example, both the first interlocking fasteners 352 and the second interlocking fastener are attached to sidewall 102 by a line of stitching that extends along each interlocking fastener 352, 354 along the straight portion of the "J".

To seal first opening 120 and/or second opening 122, each insert flap 304 is bent so as to overly its respective opening as described above. A portion of second end 316 of insert flap 304 is then inserted into first opening 120 and/or second opening 122, respectively. Securement flaps 302 are then bent to overly insert flaps 304 and connected to the other portion of sidewall through utilization of interlocking fasteners 350 which are releasably securable to one another.

Figure 3B:
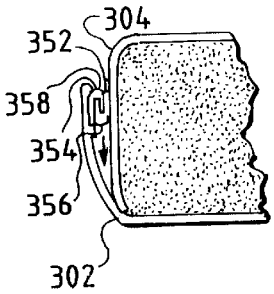
FIG. 3B is a side view of the containment chamber of FIG. 3A with the interlocking fasteners engaged.

Referring to FIG. 3B, first and second interlocking fasteners 352, 354 are shown mated together. The releasably interlocking fasteners 352, 354 are mated by snapping together a curved end 356 of the first interlocking fastener 352 and a curved end 358 of the second interlocking fastener.

Figure 4:
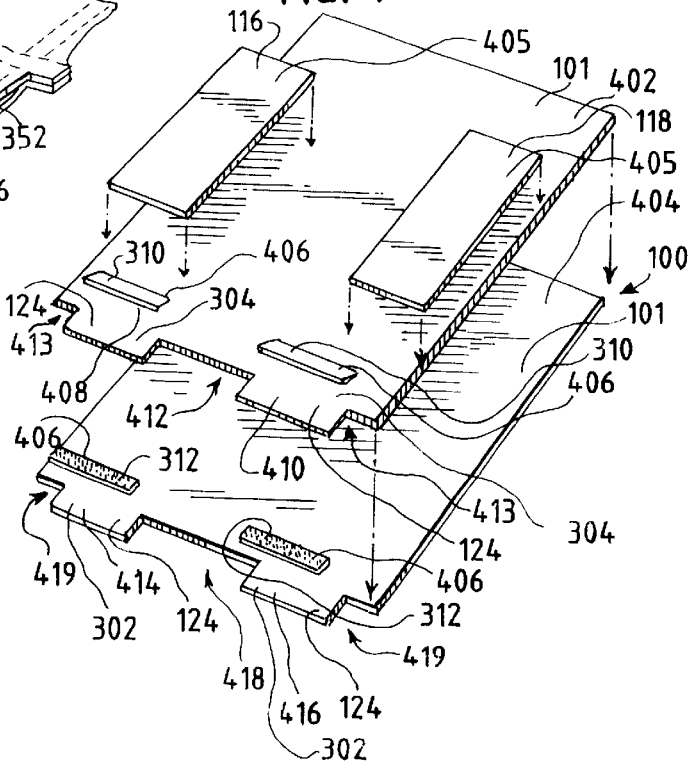
FIG. 4 is a exploded front perspective view of the barrier device of FIG. 1.

Turning to FIG. 4, an exemplary description of the components of barrier device 100 is now provided. Sidewall 101, in one example, comprises a first overlying substantially rectangular sheet 402 that is secured to a second overlying substantially rectangular sheet 404. Overlying rectangular sheets 402, 404 in one example are generally rectangular and of the same dimensions. First loop 116 and second loop 118, in one example, comprise two rectangular strips 405 that are attached to top overlying sheet 402. Accordingly, first loop 116 and second loop 118 are attached to the top of sidewall 101. Connecting strips 310, 312 comprise rectangular strips 406 of material that contain mating hook and loop fasteners. In one example, the strips are made of Velcro®.

Flaps 124 are formed from first overlying sheets 402 and second overlying sheet 404. For instance, a portion 408 of first overlying sheet 402 that corresponds to first containment chamber 104 defines one insert flap 304, and a portion 410 of first overlying sheet 402 that corresponds to second containment chamber 108 defines another insert flap 304. Cutout portions 412, 413 from the first overlying sheet 402 further define insert flaps 304.

A portion 414 of the second overlying sheet 404 that corresponds to first containment chamber 104 defines one securement flap 302, and a portion 416 of the second overlying sheet 404 that corresponds to second containment chamber 108 defines the other securement flap 302. Cutout portions 418, 419 from second overlying sheet 404 further define securement flaps 302.

Figure 5:
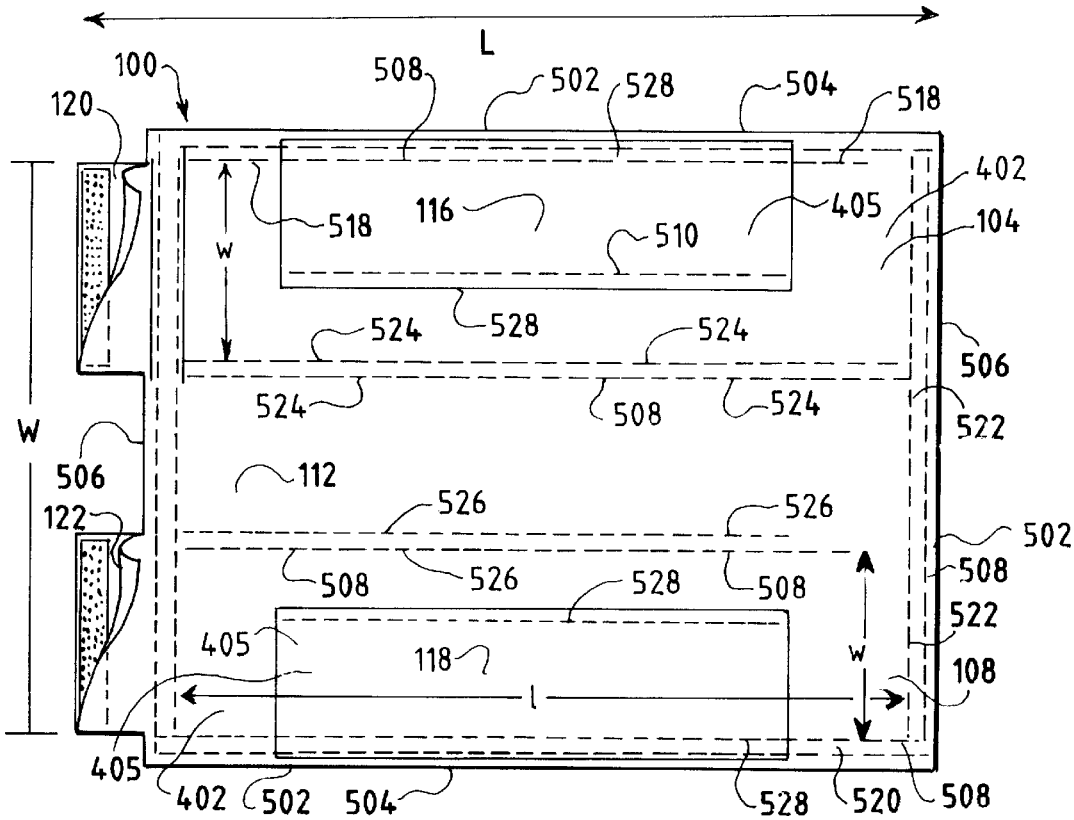
FIG. 5 is a top plan view of the barrier device of FIG. 1.

Referring to FIG. 5, an exemplary description of construction of barrier device 100 is now provided. In one example, the first overlying sheet 402 is placed over the second overlying sheet 404 (not shown). As each overlying sheets 402, 404 is substantially rectangular, each overlying sheet 402, 404 has a perimeter 502 having two opposing sides 504 and two opposing ends 506.

First overlying sheet 402 and second overlying sheet 404 are secured together by stitches 508. In one example, stitching 508 comprises a plurality of lines of stitches or double lines of stitches that extend along overlying sheets 402, 404. The particular characteristics of stitching 508 is only important to secure two overlying sheets 402, 404 reliably together when barrier device 100 is filled with filler material and in use. Therefore, it should be understood that stitch configurations, such as a zig zag, could also be used to secure the overlying sheets 402, 404 together. Similarly, the thread used to create stitching 508 must be able to reliably secure the overlying sheets 402, 404 together while the barrier device is filled with filler material and in use. Examples of thread that can be used are Nylon and Kevlar®. It should be noted, however, that Kevlar® thread wears out faster in sunlight then nylon thread. Therefore, the necessary longevity of barrier device 100 is a consideration when choosing the materials with which to construct barrier device 100.

Still referring to FIG. 5, opposing lengths 504 extend along two overlying sheets 402, 404 a length L. In one example, L is approximately 49 inches. Opposing sides 506 extend along overlying sheets 402, 404 a width W. W in one example approximately 31 inches. The dimensions given for W and L are for exemplary purposes only. The width W and length L of overlying sheets 402, 404 can be a variety of combinations. The larger that barrier device 100 is, the less number of barrier devices 100 are needed to build a wall. Nevertheless, if barrier device 100 is too large, it will be too heavy to carry. For instance, a barrier device 100 having these dimensions would weigh anywhere from 120 to 160 pounds when filled with a filler material, such as sand. Therefore, the particular dimensions of barrier device 100 should be chosen with an eye to its intended use.

Overlying sheets 402, 404 are also stitched together along perimeter 502. For instance, one line of stitches 518 extends along one of opposing sides 504 of perimeter 502 and another line of stitches 520 extends along the other of opposing sides 504 of perimeter 502. A line of stitches 522 extends along one of opposing ends 506 of perimeter 502 of sidewall 101.

To form the first containment chamber 104, the second containment chamber 108, and the connector 112, a first line of stitches 524 and a second line of stitches 526, which are spaced apart from and are generally parallel to the two opposing sides 504, extend along a portion of the length L of the two overlying sheets 402, 404. The first line of stitches 524 and the second line of stitches 526 are spaced apart and generally parallel to each other. Line of stitches 522 extends along one opposing end 506 of the perimeter 502 and is positioned transverse to the first and second lines of stitches 524, 526. Consequently, line of stitches 518, line of stitches 522, and line of stitches 524 form first containment chamber 104 and opening 120. Line of stitches 524, line of stitches 522 and second line of stitches 526 form connector 112. Line of stitches 520, line of stitches 522, and line of stitches 526 form second containment chamber 108.

In FIG. 5, barrier device 100 has a rectangular shape, as do first containment chamber 104, second containment chamber 108, and connector 112. These rectangular shapes result from the rectangular shape of overlying sheets 402, 404 and the geometric relation of lines of stitches 510 relative to each other. The shape of overlying sheets 402, 404 and the geometric relationships of lines of stitches 510 could be altered to produce numerous variations on the shape of barrier device 100 and its constituent elements (i.e., first containment chamber 104, second containment chamber 108, connector 112, etc.). All of these variations are within the scope of the present disclosure.

Referring further to FIG. 5, first loop 116 and second loop 118 are connected to first overlying sheet 402. Both loops 116, 118 are constructed of a rectangular strip of material 405 having two opposing ends 528. Strip 405 can be made of the same material as overlying sheets 402, 404 or made of another material suitable and strong enough to receive rigid support members. Opposing ends 528 are stitched to sidewall 101 in a spaced apart relationship along a length of strip 405. In one example one opposing end 528 is connected to the sidewall and another opposing end 528 is connected to another portion of the sidewall 101. For example, one opposing end 528 is secured to sidewall 101 along a perimeter of the first containment chamber 104 and the second containment chamber 108, and another opposing end 528 is secured to the sidewall 101 within the perimeter of the first containment chamber 104 and the second containment chamber 108. Another example, one opposing end 528 of each strip 405 is stitched to the sidewall 101 along one of opposing sides 504 of the perimeter 502 of overlying sheet 402. In a further example, the distance between opposing ends 528 for each loop 116 and 118 is less than the width of first containment chamber 104 and second containment chamber 108, respectively.

Referring still to FIG. 5, strips 405 are rectangular in shape and are positioned such that first loop 116 and second loop 118 are substantially bounded by areas substantially bounded by perimeters of first containment chamber 104 and second containment chamber 108, respectively. Strips 405 in one example are secured to sidewall 101 along the perimeters of first containment chamber 104 and second containment chamber 108, respectively. Strips 405, in one example, have a length that is at least equal to one half the length of the containment chambers 104, 108. Both strips 405 are generally centered along a length of containment chambers 104, 108 and are generally parallel to each other. The shape and placement of strips 405, however, could be varied in numerous ways, provided the resulting loops were sufficient to receive rigid support members and act as lift loops to help a user to position, carry, and align barrier device 100. It should also be noted that connecting strips are also shown in FIG. 5 stitched to sidewall, and could be of numerous lengths, shapes, and configurations provided they function to seal openings 120, 122.

Further referring to FIG. 5, in one example, line of stitches 524 and line of stitches 526 are each spaced a distance w from a corresponding line of stitches 518 and line of stitches 520, respectively. In one example, w equals 11 inches. Accordingly, the width of the first containment chamber 104 and the second containment chamber 108, prior to being filled with filler material, is 11 inches. Line of stitches 522, in one example, is spaced a distance l from openings 120, 122 (not shown). In one example, l equals 45 inches. Accordingly, the length of containment chambers 104, 108 is 45 inches.

Now referring to FIGS. 1 and 5, when building a barrier wall, one of containment chambers 104, 108 of one barrier device 100 can be received into channel 114 formed by filled containment chambers 104, 108 and connector 112 of another barrier device 100, to produce a sealing effect between the two barrier devices 100. Accordingly, to produce a tight seal, the width of connector 112 must be substantially equal to the width of containment chambers 104, 108 when containment chambers 104, 108 contain filler material.

One method of computing the width of connector 112 is to model filled containment chambers 104, 108 as perfect circles. In the model, the diameter of the perfect circle would be approximately equal to the width of containment chambers 104, 108 when filled with filler material. It is well known that the diameter (D) of a circle is the circumference (C) divided by Π:

$$D=C/\Pi, \quad (1)$$

If containment chambers 104, 108 were modeled as circles, the circumference of the containment chambers 104, 108 would equal approximately 22 inches (2× the width of each chamber, which in this example the width is 11 inches). Solving for equation (1), the width of chambers 104, 108 when filled with material (i.e., diameter of the hypothetical circle) is:

$$22/\Pi \text{ inches} \approx 7 \text{ inches};$$

therefore, the width of filled containment chamber 104, 108 would equal approximately 7 inches. Accordingly, the first line of stitches 524 and the second line of stitches 526 in this example should be spaced 7 inches apart to form a connector 112 approximately 7 inches wide. Therefore, in the example the ratio of the width of connector 112 to the width of one of the first containment chamber 104 and second containment chamber 108, equals 2/Π.

Figure 6A:
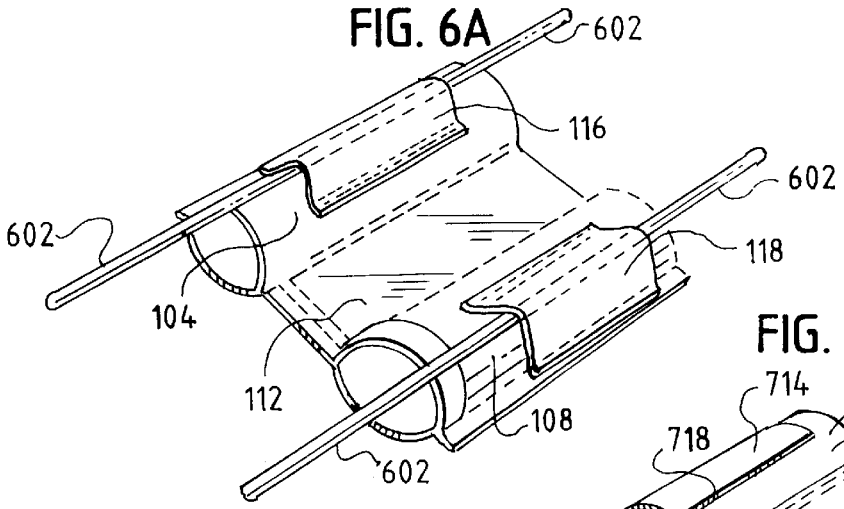
FIG. 6A is a front perspective view of the barrier device of FIG. 1 including utilization of loops that receive rigid support members.

Turning now to FIG. 6A, first loop 116 and second loop 118 are now described in use. First loop 116 and second loop 118 are shown receiving rigid support members 602. Rigid support members 602, in one example, comprise wooden poles. In another example, rigid support members 602 comprise steel or plastic polls. In a further example, the rigid support members 602 comprise an end of a fork lift. Rigid support members 602 simply must act as a means to lift, transport and position barrier device 100.

Figure 6B:
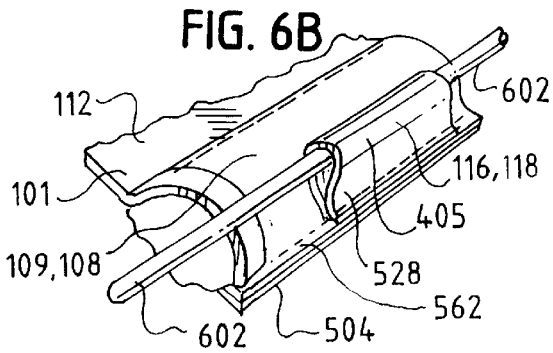
FIG. 6B is a partial view of one chamber a barrier device utilizing a lift loop having ends that are connected to the barrier device in the same location.

Referring now to FIG. 6B, an alternative to forming first loop 116 and second loop 118 by stitching opposing ends 528 to sidewall 101 in a spaced apart relationship is shown. As an alternative, first loop 116 and/or second loop 118 are formed by folding strip 405 in half and attaching opposing ends 528 to the same portion of sidewall 101. For example, one opposing end 528 is secured to sidewall 101 along a perimeter of first containment chamber 104 and/or second containment chamber 108, and the other opposing end 528 is secured to the sidewall 101 along the same portion the perimeter of the first containment chamber 104 and/or the second containment chamber 108, respectively. In one example, opposing ends 528 could be stitched to the sidewall 101 along one or both of opposing sides 504 of the perimeter 502 of overlying sheet 402.

Figure 7:
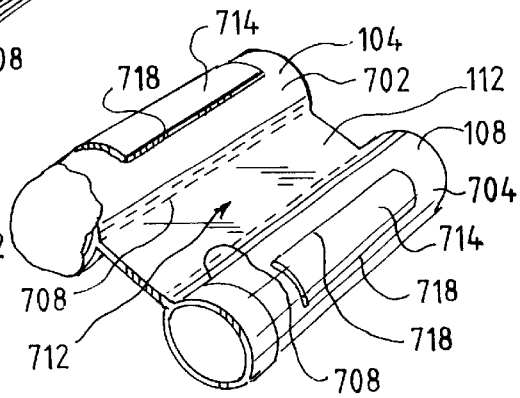
FIG. 7 is a front perspective view of another example of a barrier device.

FIG. 7 depicts an exemplary description of a barrier device 100 in accordance with another example of the present invention.

In one example, first containment chamber 104 comprises a first containment bag 702, and second containment chamber 108 comprises a second containment bag 704. Each of containment bags 702, 704 are constructed a material that is strong enough to hold a filler material and flexible enough to allow barrier device 100 to conform to a support surface. Examples of such a material are heavy duty fabric, heavy duty plastic, and/or reinforced plastic cloth. In example, first containment bag 702 and second containment bag 704 are generally rectangular in shape.

Connector 112, in one example, comprises a flexible strip of material. Strip of material or connector 112, in one example, is constructed of a flexible waterproof material. Examples of such a material are heavy duty fabric, heavy duty plastic, and/or reinforced plastic cloth. In another example, strip of material or connector 112 has a generally rectangular shape. Connector 112 is stitched along opposing perimeter lengths 708 of strip 112 to first containment bag 702 and second containment bag 704, respectively. In one example strip of material 112 extends along a length of the first containment bag 702 and second containment bag 704, respectively. In one example first containment bag 702 and second containment bag 704 each have a width greater than the width of strip of material 112.

Connector 112 in one example is positioned between first containment bag 702 and second containment bag 704. Connector 112 has a lower elevation relative the uppermost elevation of first containment bag 702 and second containment bag 704 when barrier device 100 is filled and positioned on a support surface. The lower elevation of connector 112 and its proximity between first containment bag 702 and second containment bag 704 forms a channel 712 by and along a length of first containment bag 702, second containment bag 704 and connector 112. Channel 712 is employed to receive a containment bag of another barrier device 100. Channel 712 acts to seal two barrier devices 100 together.

Barrier device 100 further comprises loops 714 that extend along the length of the first containment chamber 702 and second containment chamber 704, respectively. Loops 714 are each comprised of a strip of material that has a substantially rectangular shape. The strips of material are attached to bags 702, 704 along opposing perimeter lengths 718 of bags 702, 704 respectively. The strips, in one example, are attached to the bags by stitching. In one example strips extend to at least one half of the length of the first containment bag 702 and the second containment bag 704, respectively. In use, loops 714 receive rigid support members, in the manner similar described with respect to FIG. 6.

An exemplary description of the manner in which barrier device 100 is used to construct a barrier wall, and the sealing properties of channels 114, 712 as described above with respect to FIGS. 1 and 7 is now provided.

Figure 8A:
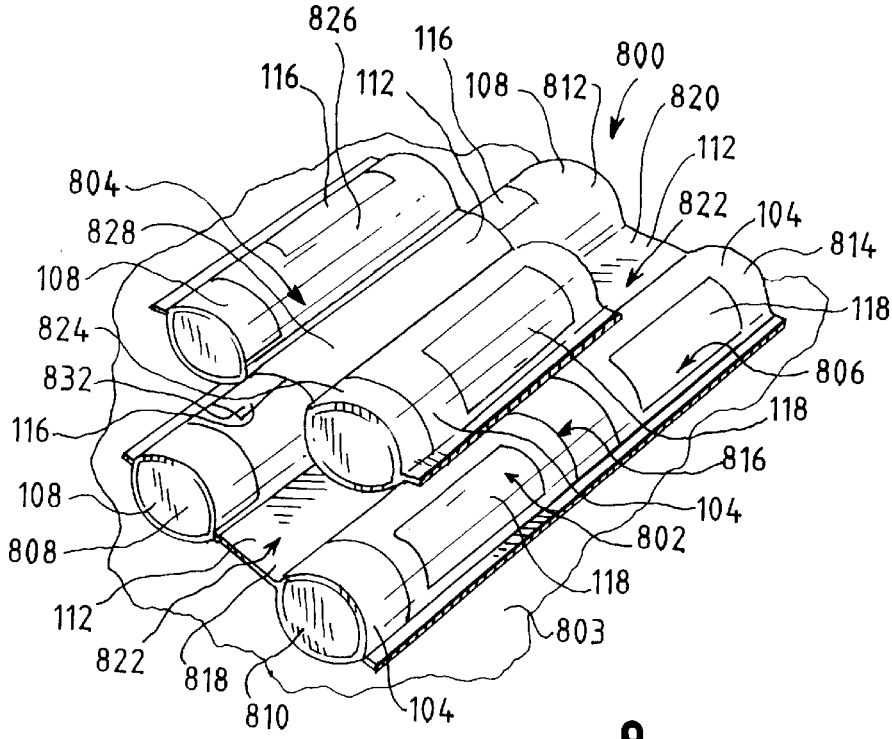
FIG. 8A is a front perspective view of two aligned barrier devices supporting a third barrier device utilized in forming a barrier wall.

Referring to FIG. 8A, shown are three barrier devices 100, a first barrier device 802, a second barrier device 804, and a third barrier device 806. Each barrier device 802, 804, 806 comprises first containment chamber 104, second containment chamber 108, and connector 112. In one example, the containment chambers 104, 108 of each barrier device 802, 804, 806 are spaced apart a distance less than a width of each containment chambers 104, 108 of each barrier device 802, 804, 806. In a further example the ratio of the width of connector 112 of each barrier device 802, 804, 806 to the width of each containment chambers 104, 108 of each barrier device 802, 804, 806 is 2/Π. In one example each barrier device 802, 804, 806 is constructed as described above with respect to FIGS. 1–7. Each containment chamber 104, 108 is filled with a filler material, such as sand or other suitable material, and sealed shut with flaps. Each barrier device 100 has loops 116, 118 that are employed as lift loops to receive rigid support members and aid in the lifting, carrying, and alignment of the barrier devices 802, 804, 806.

In one example, to build a barrier wall 800, first barrier device 802 and third barrier device 806 are both placed on a support surface 803, such as the ground, and aligned longitudinally and abutted to one another. For instance, the ends of containment chambers 808, 810 of first barrier device 802, and the ends of containment chambers 812, 814 of third barrier device 806 meet at joint 816. Connector 818 of first barrier device 802 and connector 820 of third barrier device 806 are also longitudinally aligned and meet at joint 816. Containment chambers 808, 810 and connector 818 of first barrier device 802, and containment chambers 812, 814 and connector 820 of third barrier device 806 form channel 822.

Still referring to FIG. 8A, in one example containment chamber 824 of second barrier device 804 is positioned between the containment chambers 808, 810 of first barrier device 802 and containment chambers 812, 814 of third barrier devices 806. Containment chamber 824 of second barrier device 804 is positioned in an overlying relationship with connector 818 of first barrier device 802 and connector 820 of third barrier devices 806. In one example, containment chamber 824 of second barrier device 804 is in contact with connector 818 of first barrier device 802 and connector 820 of third barrier devices 806. Containment chamber 824 of second barrier device 804 in one example is also positioned in contact with containment chambers 808, 810 of first barrier device 802 and containment chambers 812, 814 of third barrier device 806. Accordingly, containment chamber 824 of second barrier device 804 is positioned in channel 822. The downward force of containment chamber 824 reacts with channel 822 in such a way as to cause the filler material in containment chamber 824 to align in the shape of channel 822. Consequently, containment chamber 824 molds itself to at least a portion of channel 822, thereby creating a seal between the first, second, and third barrier devices, 802, 804, 806.

Referring further to FIG. 8A, connector 828 of second barrier device 804 overlies containment chamber 808 of first barrier device 802 and containment chamber 812 of third barrier device 806. In one example, connector 828 overlies and contacts a portion of both containment chamber 808 and containment chamber 812 of first barrier device 802 and third barrier devices 806, respectively. In one example containment chamber 824 of second barrier device 804 contacts a side 830 of containment chambers 808, 812 of first barrier device 802 and third barrier device 806, respectively. Containment chamber 826 of second barrier device 804 contacts an opposing side 832 of containment chambers 808, 812 of first barrier device 802 and third barrier device 806, respectively. The downward force caused by containment chamber 824, and containment chamber 826 of second barrier device 804, causes connector 828 of second barrier device 804 to exert a downward force on containment chambers 808, 812 of first barrier device 802 and third barrier device 806, respectively. The downward force causes connector 828 to conform to the shape of containment chamber 808 and containment chamber 812 of first barrier device 802 and third barrier device 806, respectively. Accordingly, containment chamber 824, containment chamber 826, and connector 828 of second barrier device 804 seal joint 816 between first barrier device 802 and third barrier device 806.

An exemplary description of a method for building a barrier wall through employment of one or more of barrier device 100 is now provided.

In one example, the building of the barrier wall involves positioning first barrier device 802 on a support surface, such as the ground. Third barrier device 806 is positioned on the support surface such that containment chamber 808, second containment chamber 810, and connector 818 of first barrier device 802 are aligned longitudinally and abut with the containment chamber 812, containment chamber 814, and connector 820 respectively of third barrier device 806.

Containment chamber 824 of second barrier device 804 is positioned between containment chamber 808 and containment chamber 810 of first barrier device 802 and containment chamber 812 and containment chamber 814 of third barrier device 806. Containment chamber 824 of second barrier device 804 in one example is positioned to overly and in certain examples contact connector 818 of first barrier device 802 and connector 820 of third barrier device 806.

Connector 828 of second barrier device 804 is positioned to overly and in certain examples contact containment chamber 808 of first barrier device 802 and containment chamber 812 of third barrier device 806. Containment chamber 824 of second barrier device 804 is positioned in contact with side 830 of containment chamber 808 of first barrier device 802 and containment chamber 812 of third barrier device 806. Containment chamber 826 of second barrier device 804 is positioned in contact with opposing side 832 of containment chamber 808 of first barrier device 802 and containment chamber 812 of third barrier device 806.

Figure 8B:
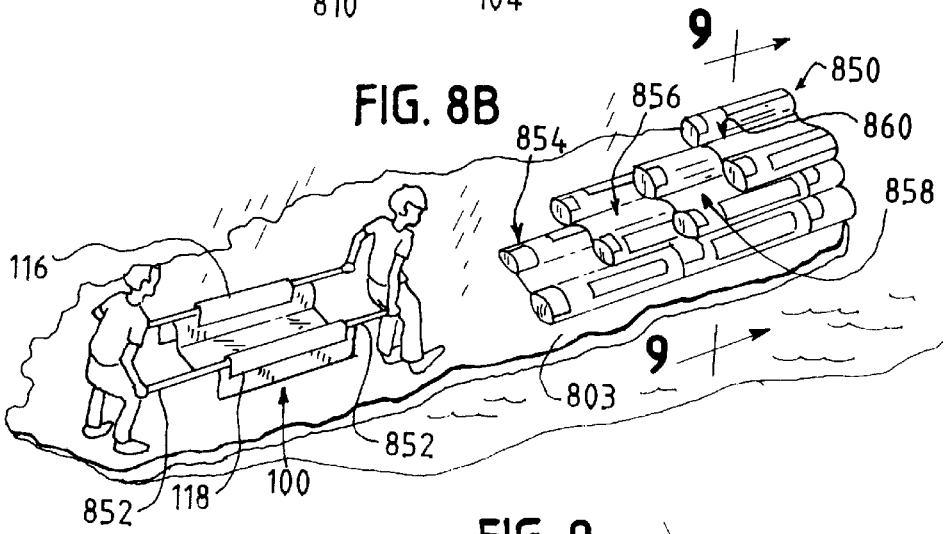
FIG. 8B is a front perspective view of the construction of a barrier wall.

Referring now to FIG. 8B, two users of barrier device 100 are shown constructing a barrier wall 850 in accordance with one example of the present invention.

The users are employing rigid support members 852 that are inserted through loops 116, 118 to lift and carry a barrier device 100 to wall 850. Upon reaching wall 850, the users will position the barrier device 100 with respect to other barrier devices 100, as described above with respect to FIG. 8A.

Figure 9:
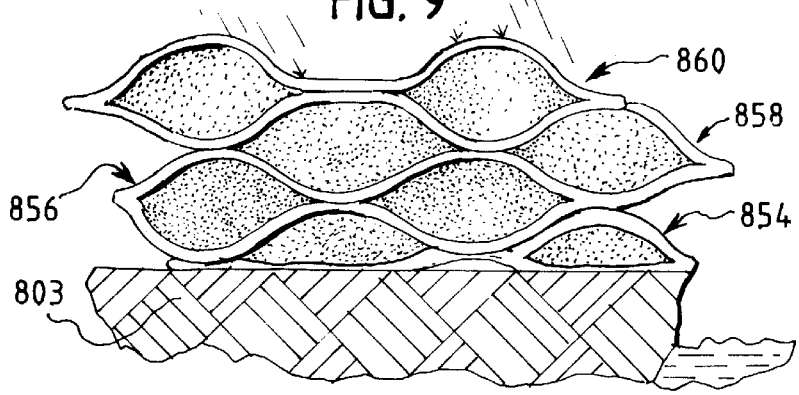
FIG. 9 is a cross section view taken along line 9—9 of FIG. 8B.

Referring still to FIGS. 8B and 9, wall 850 comprises a first layer 854 of barrier devices 100, a second layer 856 of barrier devices 100, a third layer 858, and a fourth layer 860. Each layer comprises a plurality of barrier devices 100 positioned in an end-to-end configuration. The exact number of barrier devices 100 for each layer depends on the length and shape required for barrier wall 850 to perform its chosen function.

First layer 854 rests on a support surface 803, such as the ground. Containment chambers 104, 108 in barrier devices 100 positioned in first layer 854 are generally only half filled with filler material. Half filling the barrier devices 100 in first layer 854 allows the connectors 112 of barrier devices 100 in first layer 854 to better seal with the support surface when containment chambers 104, 108 of the second layer 856 overly connectors 112 of first layer, as described in FIG. 8A. The containment chambers 104, 108 of the remaining layers 856, 858, 860 are generally full.

Second layer 856 of barrier devices 100 are positioned over the first layer 854 in an end-to-end manner. The barrier devices 100 of the second layer 856 are placed over first layer 854 as shown in FIG. 8A, to mold the containment chambers 104, 108, of second layer 856 to the channels formed in the first layer 854 and to allow connectors 112 of the second layer 856 barrier devices to seal any joints between the barrier devices 100 of the first layer 854.

Third layer 858, fourth layer 860, and any desired additional layers are added to wall 850 in the same manner with containment chambers 104, 108 of the upper layer resting between containment chambers 104, 108 of the lower layer and overlying respective connectors 112. Connectors 112 of the upper chamber also rest on a portion of the containment chambers 104, 108 as described above with respect of FIG. 8A.

Wall 850, if built as provided above extends four chambers deep. Wall 850 could be built to a greater desired height. Wall 850 could be built to a greater desired depth by making first layer 854 deeper. In addition, wall 850 could be made less deep by employing a combination of barrier device 100 with a single chambered barrier device. For instance, the first layer 854, the third layer 858, etc., could comprise a plurality of barrier devices 100 positioned end-to-end, while the second layer 856, the fourth layer 860, etc., could comprise a plurality of single chambered barrier devices stacked end to end.

Although several examples of the invention are described herein, it will be apparent to those of relevant skill in the art that various modifications, substitutions and the like can be made without departing from the spirit of the invention and these are therefore considered to be within the scope of the invention as defined herein.

What is claimed is:

1. A barrier device, comprising:

a first containment chamber;

a second containment chamber; and a connector that secures the first containment chamber to the second containment chamber; wherein a ratio of a width of the connector to a width of one of the first containment chamber and the second containment chamber is approximately $2/\pi$.

2. The barrier device of claim 1 in which the first containment chamber is defined by a first portion of a sidewall, the second containment chamber is defined by a second portion of the sidewall, and the connector is defined by a third portion.

3. The barrier device of claim 2, wherein the connector is positioned between the first chamber and the second chamber.

4. The barrier device of claim 3, wherein the connector is positioned to extend along at least a portion of a length the first chamber and to extend along at least a portion of a length of the second chamber.

5. The barrier device of claim 4, wherein the connector extends generally entirely along the length of the first chamber and extends generally entirely along the length of the second chamber.

6. The barrier device of claim 5, wherein the connector has a lower elevation relative to an elevation of the first and second chambers with the chambers containing filler material with the barrier device positioned on a support surface.

7. The barrier device of claim 6, wherein a channel is formed by and along the length of the first and second chambers and connector.

8. The barrier device of claim 2, wherein a length of the sidewall is greater than a width of the sidewall.

9. The barrier device of claim 8, wherein the first chamber, the second chamber, and the connector each form a substantially rectangular shape.

10. The barrier device of claim 8 wherein the first chamber, the second chamber and the connector form a substantially rectangular shape.

11. The barrier device of claim 2 wherein the sidewall is constructed of a flexible and waterproof material.

12. The barrier device of claim 2 including a first opening defined by the first portion of the sidewall and in communication with the first chamber and a second opening defined by the second portion of the sidewall and in communication with the second chamber.

13. The barrier device of claim 12, wherein the first opening is positioned at an end of and along at least a portion of a width of the sidewall.

14. The barrier device of claim 12, wherein the second opening is positioned at an end of and along at least a portion of a width of the sidewall.

15. The barrier device of claim 12, wherein the first and second openings are positioned at a same end of the sidewall.

16. The barrier device of claim 12 including a securement flap which comprises a first end attached to the first portion of the sidewall and extends along at least the first opening, and a second end releasably securable to another portion of the first portion of the sidewall with securement flap overlying the first opening.

17. The barrier device of claim 16 wherein the first end of the securement flap is integral with the first portion of the sidewall.

18. The barrier device of claim 16 including a first connecting strip attached to the other portion of the first portion of the sidewall and positioned along at least a portion of the first opening and a second connecting strip attached to the second end of the securement flap in which the first connecting strip and the second connecting strip carry mating hook and loop fasteners.

19. The barrier device of claim 16 including an insert flap having a first end attached to the other portion of the first portion of the sidewall and extends along at least a portion of the first opening and a second end insertable into the first opening.

20. The barrier device of claim 19 wherein the first end of the insert flap is integral with the other portion of the first portion of the sidewall.

21. The barrier device of claim 16, including another securement flap which comprises a first end attached to the second portion of the sidewall and extends along at least the second opening and a second end releasably securable to another portion of the second portion of the sidewall with the other securement flap overlying the second opening.

22. The barrier device of claim 21, wherein the first end of the other securement flap is integral with the second portion of the sidewall.

23. The barrier device of claim 21 including a first connecting strip attached to the other portion of the second portion of the sidewall positioned along at least a portion of the second opening and a second connecting strip attached to the second end of the other securement flap in which the first connecting strip and the second connecting strip carry mating hook and loop fasteners.

24. The barrier device of claim 21 including a second insert flap having a first end attached to the other portion of the second portion of the sidewall and extends along at least a portion of the second opening and a second end insertable into the second opening.

25. The barrier device claim 24, wherein the first end of the second insert flap is integral with the other portion of the second portion of the sidewall.

26. The barrier device of claim 2, wherein the sidewall comprises two overlying sheets secured together.

27. The barrier device of claim 26, wherein the two overlying sheets are stitched together along a portion of a perimeter of at least one of the two overlying sheets.

28. The barrier device of claim 27, wherein the perimeter has two opposing sides and two opposing ends.

29. The barrier device of claim 28, wherein the two overlying sheets are secured together with stitches along the two opposing sides and one end the perimeter.

30. The barrier device of claim 29, wherein the overlying sheets are generally rectangular and generally of the same dimensions.

31. The barrier device of claim 29, including a first line of stitches spaced apart from the two opposing sides and extending along a portion of a length of the overlying sheets, and a second line of stitches spaced apart from the two opposing sides and from the first line of stitches and extending along a portion of the length of the overlying sheets.

32. The barrier device of claim 31, wherein the first line of stitches and the second line of stitches extend in a direction generally parallel to one another and generally parallel to the two opposing sides of the overlying sheets.

33. The barrier device of claim 32 including a third line of stitches positioned transverse to the first and second lines of stitches along one of opposing ends of the perimeter of the sidewall.

34. The barrier device of claim 2, including at least one loop constructed of a strip having two opposing ends each secured to a portion of the sidewall.

35. The barrier device of claim 34, wherein the two opposing ends are connected to the portion of the sidewall.

36. The barrier device of claim 35, wherein the two opposing ends are secured to the sidewall along a perimeter of one of the first and second containment chambers.

37. The barrier device of claim 34, wherein one opposing end is connected to one portion of the sidewall and another opposing end is connected to another portion of the sidewall.

38. The barrier device of claim 37, wherein the two opposing ends are spaced apart along the sidewall.

39. The barrier device of claim 34, wherein the strip has a generally rectangular shape.

40. The barrier device of claim 39, wherein one end and an opposing end of the strip are each stitched to the sidewall.

41. The barrier device of claim 40, wherein the strip of the at least one loop is positioned on the sidewall in an area of the sidewall substantially bounded by a perimeter of one of the first containment chamber and the second containment chamber.

42. The barrier device of claim 41 wherein one of the opposing ends of the strip is secured to the sidewall along a perimeter of one of the first and second containment chambers.

43. The barrier device of claim 41 wherein the strip of the at least one loop is generally centered along a length of one of the first and second containment chambers.

44. The barrier device of claim 41 wherein the strip has a length which extends to at least one half the length of one of the first and second containment chambers.

45. The barrier device of claim 41, wherein the at least one loop includes a first loop positioned on the sidewall substantially bounded by an area defined by a perimeter of the first containment chamber, and a second loop positioned on the sidewall substantially bounded by an area defined by a perimeter of the second containment chamber.

46. The barrier device of claim 1 wherein the first containment chamber includes a bag and the second containment chamber includes another bag.

47. The barrier device of claim 46 wherein the bags are constructed of a flexible and waterproof material.

48. The barrier device of claim 46 wherein the connector is constructed of a flexible material.

49. The barrier device of claim 46, wherein the connector is positioned between the first bag and the second bag.

50. The barrier device of claim 49, wherein the connector has a lower elevation relative to an elevation of the first bag and second bag with the first and second bags containing filler material and with the barrier device positioned on a support surface.

51. The barrier device of claim 50, wherein a channel is formed by and along a length of the first bag and second bag and connector.

52. The barrier device of claim 49, wherein the first bag, the second bag, and the connector each have a generally rectangular shape.

53. The barrier device of claim 52, wherein the connector extends along a length of the first bag and along a length of the second bag.

54. The barrier device of claim 52, wherein the connector comprises a strip of material that is stitched along opposing perimeter lengths of the connector to the first bag and the second bag.

55. The barrier device of claim 46, including at least one loop connected to one of the first bag and the second bag.

56. The barrier device of claim 55, wherein the at least one loop includes a first loop made of a rectangular strip of material in which the strip of the first loop is stitched along opposing perimeter lengths to the first bag, and a second loop constructed of another rectangular strip of material in which the strip of the second loop is stitched along opposing perimeter lengths to the second bag.

57. The barrier device of claim 56, wherein the lengths of each of the strips of the first and second loop extend to at least one half of the length of the first and second bag respectively.

58. The barrier device of claim 56, wherein one of the perimeter lengths of each of the strips of the first loop and the second loop are stitched to a perimeter of the first and second bags respectively.

59. A barrier device, comprising:

at least one chamber defined by a sidewall; and at least one loop constructed of a strip secured at opposing ends of the strip to the sidewall to permit insertion of a rigid support member into the at least one loop, wherein the at least one chamber comprises a first chamber and a second chamber defined by the sidewall, and the at least one loop comprises a first loop and a second loop that are each constructed of a strip of material secured at opposing ends of the strip to the sidewall in which the first loop is secured to the sidewall and the second loop is secured to the sidewall to permit insertion of a rigid support member into each of the first and second loops.

60. The barrier device of claim 59, wherein the strip is substantially rectangular in shape.

61. The barrier device of claim 59, wherein the opposing ends of the strip comprise a first length and a second length positioned along a perimeter of the strip.

62. The barrier device of claim 61, wherein the sidewall forms a rectangular shape.

63. The barrier device of claim 61, wherein a distance between the opposing ends is less than a width of the chamber.

64. The barrier device of claim 61, wherein the first length and the second length of the strip are at least one half a length of the chamber.

65. The barrier device of claim 61, wherein the opposing ends are stitched to the sidewall.

66. The barrier device of claim 59, wherein the at least one loop is positioned on the sidewall generally centered along a length of the chamber.

67. The barrier device of claim 59, wherein one of the opposing ends of the strip of the at least one loop is secured to a perimeter of the chamber and the other of the opposing ends is secured to the sidewall within the perimeter of the chamber.

68. The barrier device of claim 59 wherein the first and second chambers are secured together with a connector secured to each of the first and second chambers and positioned between the first and second chambers with the first and second chambers in spaced apart relationship.

69. The barrier device of claim 59 wherein the first chamber and second chamber each extend a greater distance along a length than along a width.

70. The barrier device of claim 59 wherein the first chamber and second chamber each extend a greater distance along a length than along a width.

71. The barrier device of claim 70 wherein the first loop is secured to the sidewall which defines the first chamber and extends along at least a portion of the length of the first chamber and the second loop is secured to the sidewall which defines the second chamber and extends along at least a portion of the length of the second chamber.

72. The barrier device of claim 71 wherein the first and second loops are positioned generally parallel to one anther.

73. The barrier device of claim 71 wherein the first and second loops extend in length at least one half the length of the first and second chambers respectively.

74. The barrier device of claim 59, wherein the strip of the first loop and the second loop are generally rectangular in shape.

75. The barrier device of claim 74, wherein the opposing ends of each strip of the first loop and the second loop comprise a first length and a second length positioned along a perimeter of each of the strips of the first and second loop.

76. The barrier device of claim 75, wherein the first chamber and the second chamber are substantially rectangular in shape.

77. The barrier device of claim 76, wherein distances between the first length and the second length of each of the first loop and the second loop are less than a width of the first chamber and a width of the second chamber, respectively.

78. The bag barrier device of claim 77, wherein the first loop is substantially centered along a length of the first chamber and the second loop is substantially centered along a length of the second chamber.

79. The barrier device of claim 75, wherein the opposing ends of each strip of the first and second loops are stitched to the sidewall in which one opposing end of the strip of the first loop is positioned proximate to the perimeter of the first chamber and one opposing end of the strip of the second loop is positioned proximate to the perimeter of the second chamber.

80. The barrier device of claim 73, wherein the first loop is positioned within an area of the sidewall defined by a perimeter of the first chamber and the second loop is positioned within an area of the sidewall defined by a perimeter of the second chamber.

81. The barrier device of claim 73 wherein the sidewall defining the first and second chambers has a top and bottom sides in which the first and second loop are both secured to the top side of the sidewall.

82. A barrier wall, comprising:

a first barrier device having a first containment chamber, a second containment chamber and a connector; and a second barrier device having a containment chamber positioned between the first containment chamber and the second containment chamber of the first barrier device and positioned in overlying relationship to the connector; wherein the containment chamber of the second barrier device is in contact with the first containment chamber and the second containment chamber of the first barrier device, and wherein the first and second containment chambers of the first barrier device are spaced apart a distance less than a width of one of the first and second containment chambers.

83. The barrier wall of claim 82, wherein the containment chamber of the second barrier device is in contact with the connector of the first barrier device.

84. The barrier wall of claim 82 wherein the second barrier device includes a first containment chamber, a second containment chamber, and a connector.

85. The barrier wall of claim 84 wherein the connector of the second barrier device overlies a portion of the first containment chamber of the first barrier device.

86. The barrier wall of claim 85 wherein the connector of the second barrier device contacts the first containment chamber of the first barrier device.

87. The barrier wall of claim 84 wherein the first containment chamber of the second barrier device contacts a side of the first containment chamber of the first barrier device and the second containment chamber of the second barrier device contacts an opposing side of the first containment chamber of the first barrier device.

88. The barrier wall of claim 82 wherein the connector of the first barrier device is constructed of a flexible material.

89. The barrier wall of claim 82, wherein the connector of the first barrier device has a lower elevation relative to an elevation of the first and second containment chambers with the chambers containing material and with the first barrier device positioned on a support surface.

90. The barrier wall of claim 89 wherein a channel is formed by and along a length of the first and second containment chambers and the connector of the first barrier device.

91. The barrier wall of claim 89 wherein the first containment chamber of the second barrier device is positioned in the channel.

92. The barrier wall of claim 82 wherein the first and second containment chambers of the first barrier device and the containment chamber of the second barrier device are constructed of flexible waterproof material.

93. The barrier wall of claim 82 wherein the first and second containment chambers of the first barrier device are spaced apart a distance less than a width of the containment chamber of the second barrier device.

94. The barrier wall of claim 82 wherein a ratio of a width of the connector of the second barrier device to a width of the containment chamber of the second barrier device is approximately $2/\pi$.

95. The barrier wall of claim 82, including a third barrier device having a first containment chamber, a second containment chamber, and a connector wherein the first containment chamber the second containment chambers, and the connector of the first barrier device are each longitudinally aligned with the first containment chamber, the second containment chamber and the connector, respectively, of the third barrier device.

96. The barrier wall of claim 95 wherein a channel is formed with the first containment chambers, the connectors and second containment chambers of the first and third barrier devices.

97. The barrier wall of claim 96 wherein the first containment chamber of the second barrier device is positioned in the channel and overlies at least a portion of the connectors of both the first and third barrier devices.

98. The barrier wall of claim 97 wherein a portion of the first containment chamber of the second barrier device contacts the connectors of the first and third barrier devices.

99. The barrier wall of claim 95 wherein a portion of the first containment chamber of the second barrier device contacts at least one of the first and second containment chambers and the connector of the first barrier device.

100. The barrier wall of claim 95 wherein a portion of the first containment chamber of the second barrier device contacts at least one of the first and second containment chambers and the connector of the third barrier device.

101. The barrier wall of claim 95 wherein the second barrier device has a connector member secured to the first containment chamber and secured to the second containment chamber and positioned between the first containment and the second containment chambers with the first containment and the second containment chambers in a spaced apart relationship.

102. The barrier wall of claim 101 wherein the connector of the second barrier device overlies a portion of the first containment chamber of the first barrier device and a portion of the first containment chamber of the third barrier device.

103. The barrier wall of claim 102 wherein a portion of the first containment chamber of the second barrier device contacts a side of the first containment chamber of the first barrier device and a portion of the second containment chamber of the second barrier device contacts an opposing side the first containment chamber of the first barrier device, and another portion of the first containment chamber of the second barrier device contacts a side of the first containment chamber of the third barrier device and a portion of the second containment chamber of the second barrier device contacts an opposing side of the first containment chamber of the third barrier device.

104. The barrier wall of claim 103 wherein a portion of the first containment chamber of the second barrier device contacts a side of the second containment chamber of the first barrier device, and another portion of the first containment chamber of the second barrier device contacts a side of the second containment chamber of the third barrier device.

105. A method, comprising the steps of:

positioning a first barrier device, having a first containment chamber, a second containment chamber, and a connector on a support surface; and positioning a portion of a containment chamber of a second barrier device in contact with the first containment chamber and the second containment chamber of the first barrier device and in overlying relationship to the connector, wherein the first and second containment chambers of the first barrier device are spaced apart a distance less than a width of one of the first and second containment chambers.

106. The method of claim 105, wherein the step of positioning the portion of the containment chamber comprises the step of:

positioning the portion of the containment chamber of the second barrier device in contact with the connector of the first barrier device.

107. The method of claim 105, further comprising the step of:

positioning a portion of a connector of the second barrier device to overly one of the first containment chamber and the second containment chamber of the first barrier device.

108. The method of claim 107, wherein the step of positioning the portion of the connector comprises the step of:

positioning the portion of the connector of the second barrier device to contact the one of the first containment chamber and the second containment chamber of the first barrier device.

109. The method of claim 107, further comprising the step of:

positioning a portion of another containment chamber of the second barrier device in contact with one of the first containment chamber and the second containment chamber of the first barrier device.

110. The method of claim 109, wherein the step of positioning the portion of the containment chamber comprises the step of:

positioning the portion of the containment chamber of the second barrier device in contact with a side of the one of the first containment chamber and the second containment chamber of the first barrier device.

111. The method of claim 110, wherein the step of positioning the portion of the other containment chamber of the second barrier device comprises the step of:

positioning the portion of the other containment chamber of the second barrier device in contact with an opposing side of the one of the first containment chamber and the second containment chamber of the first barrier device.

112. The method of claim 111, further comprising the step of:

positioning a third barrier device, having a first containment chamber, a second containment chamber, and a connector onto the support surface such that the first containment chamber, the second containment chamber and the connector of the first barrier device are each aligned longitudinally with the first containment chamber, the second containment chamber, and the connector, respectively, of the third barrier device.

113. The method of claim 112, further comprising the step of:

positioning another portion of the containment chamber of the second barrier device between the first containment chamber and the second containment chamber of the third barrier device and in overlying relationship with the connector of the third barrier device.

114. The method of claim 113, wherein the step of positioning the other portion of the containment chamber comprises the step of:

positioning the other portion of the containment chamber of the second barrier device in contact with the connector of the third barrier device.

115. The method of claim 113, wherein the step of positioning the other portion of the containment chamber comprises the step of:

positioning the other portion of the containment chamber of the second barrier device in contact with at least one of one of the first containment chamber and the second containment chamber of the third barrier device.

116. The method of claim 113, further comprising the step of:

positioning another portion of the connector of the second barrier device to overly one of the first containment chamber and the second containment chamber of the third barrier device.

117. The method of claim 116, wherein the step of positioning the other portion of the connector comprises the step of:

positioning the other portion of the connector of the second barrier device to contact the one of the first containment chamber and the second containment chamber of the third barrier device.

118. The method of claim 116, further comprising the step of:

positioning another portion of the other containment chamber of the second barrier device to contact the one of the first containment chamber and the second containment chamber of the third barrier device.

119. The method of claim 118, wherein the step of positioning the other portion of the containment chamber comprises the step of:

positioning the other portion of the containment chamber of the second barrier device in contact with a side of the one of the first containment chamber and the second containment chamber of the third barrier device.

120. The method of claim 119 wherein the step of positioning the other portion of the other containment chamber of the second barrier device comprises the step of:

positioning the other portion of the other containment chamber of the second barrier device in contact with an opposing side of the one of the first containment chamber and the second containment chamber of the third barrier device.

121. A barrier device, comprising:

a first containment chamber defined by a first portion of a sidewall;

a second containment chamber defined by a second portion of the sidewall; and a connector defined by a third portion of the sidewall that secures the first containment chamber to the second containment chamber;

a first opening defined by the first portion of the sidewall and in communication with the first containment chamber;

a second opening defined by the second portion of the sidewall and in communication with the second containment chamber; and a securement flap having a first end attached to the first portion of the sidewall and extending along at least the first opening and a second end releasably securable to another portion of the first portion of the sidewall with the securement flap overlying the first opening.

122. A barrier device, comprising:

a first containment chamber which comprises a first bag;

a second containment chamber which comprises a second bag; and a connector positioned between the first bag and the second bag that secures the first containment chamber to the second containment chamber; wherein a ratio of a width of the connector to a width of one of the first containment chamber and the second containment chamber is approximately $2/\pi$.

123. A barrier wall, comprising:

a first barrier device having a first containment chamber, a second containment chamber and a connector; and a second bamer device having a containment chamber positioned between the first containment chamber and the second containment chamber of the first barrier device and positioned in overlying relationship to the connector; wherein the containment chamber of the second barrier device is in contact with the first containment chamber and the second containment chamber of the first barrier device, wherein the first and second containment chambers of the first barrier device are spaced apart a distance less than a width of the containment chamber of the second barrier device.

124. A barrier wall, comprising:

a first barrier device having a first containment chamber, a second containment chamber and a connector; and a second barrier device having a containment chamber positioned between the first containment chamber and the second containment chamber of the first barrier device and positioned in overlying relationship to the connector; wherein the containment chamber of the second barrier device is in contact with the first containment chamber and the second containment chamber of the first barrier device, wherein a ratio of a width of the connector of the first barrier device to a width of the containment chamber of the second barrier device is $2/\pi$.

* * * * *